US008963034B2

(12) United States Patent
Liang et al.

(10) Patent No.: US 8,963,034 B2
(45) Date of Patent: Feb. 24, 2015

(54) KEYSWITCH STRUCTURE

(75) Inventors: Chen-Yi Liang, New Taipei (TW); Cheng-Hsiang Chuang, New Taipei (TW); Chun-Chien Chen, New Taipei (TW); Shun-De Bai, New Taipei (TW); San-Pao Kao, New Taipei (TW)

(73) Assignee: Wistron Corporation, New Taipei (TW)

( * ) Notice: Subject to any disclaimer, the term of this patent is extended or adjusted under 35 U.S.C. 154(b) by 385 days.

(21) Appl. No.: 13/441,390

(22) Filed: Apr. 6, 2012

(65) Prior Publication Data

US 2012/0255845 A1 Oct. 11, 2012

(30) Foreign Application Priority Data

Apr. 11, 2011 (TW) ..... 100112437 A

(51) Int. Cl.
*H01H 3/12* (2006.01)
*H01H 13/70* (2006.01)

(52) U.S. Cl.
CPC ..... *H01H 3/122* (2013.01); *H01H 2227/036* (2013.01); *H01H 2231/042* (2013.01)
USPC ..... 200/344; 200/5 A

(58) Field of Classification Search
CPC ..... H01H 13/065; H01H 13/88; H01H 13/70; H01H 3/12; H01H 3/122
USPC ..... 200/344, 345, 5 A, 5 R, 512–517; 400/490–496
See application file for complete search history.

(56) References Cited

U.S. PATENT DOCUMENTS

| | | | | |
|---|---|---|---|---|
| 6,318,695 | B1 * | 11/2001 | Hu | 248/371 |
| 6,340,803 | B1 * | 1/2002 | Li | 200/344 |
| 8,053,697 | B2 * | 11/2011 | Lin | 200/344 |
| 2010/0243420 | A1 * | 9/2010 | Lin | 200/344 |

FOREIGN PATENT DOCUMENTS

| | | | |
|---|---|---|---|
| CN | 101599379 | A | 12/2009 |
| CN | 201616368 | U | 10/2010 |

OTHER PUBLICATIONS

Chinese Patent Office Office Action dated Feb. 2, 2014 for CN Application No. 2011101014721; 6 pages (untranslated).
English translation of the Sections boxes for CN Office Action dated Feb. 2, 2014 for CN Application No. 201110101472.2; 5 pages.
English translation of CN 101599379A dated Dec. 9, 2009; 24 pages.
English translation of CN 201616368U dated Oct. 27, 2010; one page.

* cited by examiner

*Primary Examiner* — Amy Cohen Johnson
*Assistant Examiner* — Marina Fishman
(74) *Attorney, Agent, or Firm* — John A. Fortkort; Fortkort & Houston P.C.

(57) ABSTRACT

A keyswitch structure includes a bottom board, a circuit board disposed on the bottom board, a resilient member, a key cap and two supporting members. The bottom board is formed with two first holes spaced apart from each other. The key cap is located over the bottom board, and includes two pivoting portions that are spaced apart from each other. Each supporting member has an end pivoted to a respective one of the pivoting portions of the key cap, and an opposite end pivoted to the bottom board. When the key cap is moved toward the bottom board and presses the resilient member, each of the supporting members engages at least partly a corresponding one of the first holes, and the resilient member triggers the circuit board so as to generate a corresponding signal.

20 Claims, 8 Drawing Sheets

KEYSWITCH STRUCTURE

CROSS-REFERENCE TO RELATED APPLICATION

This application claims priority of Taiwanese Application No. 100112437, filed on Apr. 11, 2011, the disclosure of which is incorporated herein by reference.

BACKGROUND OF THE INVENTION

1. Field of the Invention

The invention relates to a keyswitch structure, more particularly to a keyswitch structure for use in thin-type keyboards.

2. Description of the Related Art

Electronic devices, such as personal computers (PC) and laptops, have become indispensable to daily life and work. A keyboard, serving as an input device, is a prominent component of electronic devices.

FIG. 1 shows a sectional view of a conventional keyswitch structure 900 on a keyboard. The keyswitch structure 900 includes a bottom board 901, a key cap 902, a circuit board 903 disposed on the bottom board 901, and a resilient member 904 and two supporting members 905 disposed between the bottom board 901 and the key cap 902. After the key cap 902 is pressed by a user, the resilient member 904 provides a restoring force exerted on the key cap 902 for restoring the key cap 902 back to its original position.

Nonetheless, in the conventional keyswitch structure 900, the two supporting members 905 are configured to intersect each other, and require a relatively large space for operation when the key cap 902 is pressed by the user. This configuration undesirably results in a relatively great height of the keyswitch structure 900, and is disadvantageous in applications where thinner keyboards are preferred.

SUMMARY OF THE INVENTION

Therefore, the object of the present invention is to provide a keyswitch structure that has a relatively low height.

Accordingly, a keyswitch structure of the present invention comprises a bottom board, a circuit board disposed on the bottom board, a resilient member, a key cap and two supporting members. The bottom board is formed with two first holes that are spaced apart from each other. The circuit board is disposed on the bottom board. The resilient member is disposed on the circuit board and is located between the first holes. The key cap is located over the bottom board, and includes two pivoting portions that are spaced apart from each other and that are disposed on one side of the key cap adjacent to the bottom board. Each of the supporting members has an end that is pivoted to a respective one of the pivoting portions of the key cap, and an opposite end that is pivoted to the bottom board. The supporting members are registered respectively with the first holes. Therefore, when the key cap is moved toward the bottom board and presses the resilient member, each of the supporting members engages at least partly a corresponding one of the first holes, thereby shortening the distance between the key cap and the bottom board and subsequently decreasing the height of the keyswitch structure. At this time, the resilient member also triggers the circuit board so as to generate a corresponding signal.

Preferably, each of the supporting members includes a supporting plate, a first supporting rod and a second supporting rod connected respectively to opposite ends of the supporting plate. The first supporting rods of the supporting members are pivoted respectively to the pivoting portions of the key cap. The second supporting rods are pivoted to the bottom board. Moreover, the bottom board is formed with two spaced-apart grooves in a bottom surface thereof. Each of the second supporting rods engages pivotally a closer one of the grooves. The keyswitch structure further comprises two covering members covering the grooves, respectively. Thus, the pivot action of the first supporting rods of the supporting members is configured to drive the key cap to move vertically with respect to the bottom board.

Preferably, the keycap further includes two engaging seats that are disposed on the one side of the key cap adjacent to the bottom board and that are spaced apart from each other. The bottom board is further formed with two second holes that are spaced apart from each other and that are registered respectively with the engaging seats. When the key cap is moved toward the bottom board and presses the resilient member, each of the engaging seats engages a respective one of the second holes. Moreover, the keyswitch structure further comprises a balancing member that engages the engaging seats of the key cap and that is for reducing inclination of the key cap when the key cap is moving vertically with respect to the bottom board.

The effect of this invention is that, since the bottom board of the keyswitch structure is formed with the first holes and the second holes, when the key cap is pressed by the user and moves toward the bottom board, the supporting members engage at least partly a corresponding one of the first holes, and each of the engaging seats engages a respective one of the second holes. Such configuration shortens the distance between the key cap and the bottom board, thereby lowering the overall height of the keyswitch structure.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
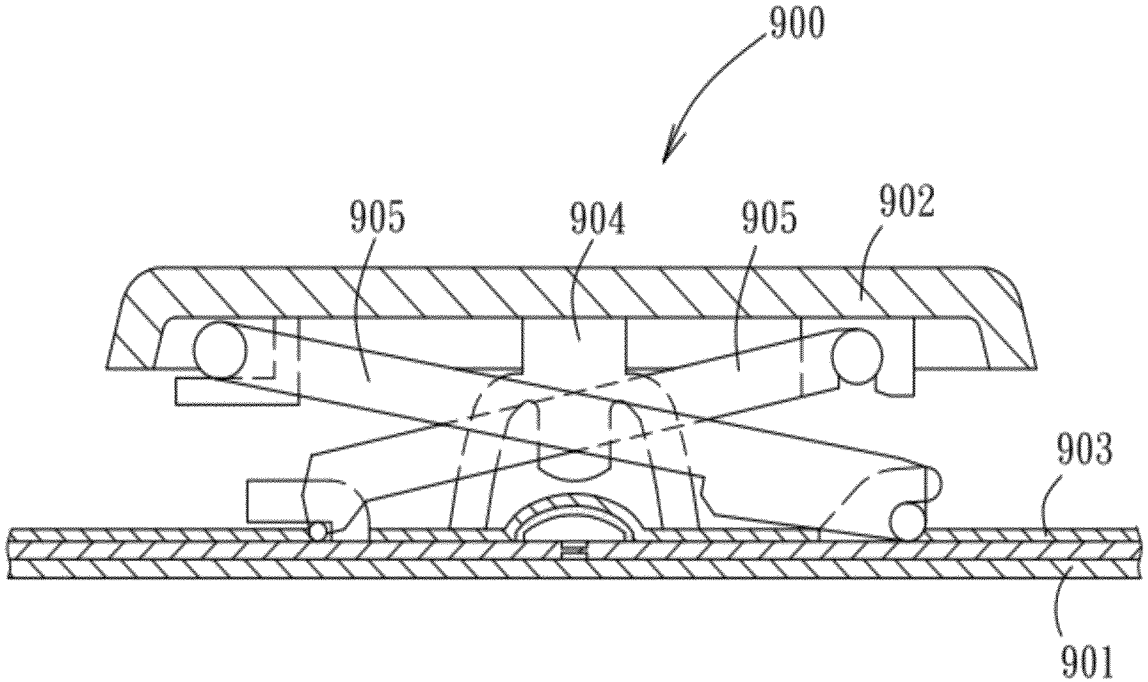
FIG. 1 PRIOR ART
FIG. 1 is a sectional view of a conventional keyswitch structure.

Before the present invention is described in greater detail, it should be noted that like elements are denoted by the same reference numerals throughout the disclosure.

Figure 2:
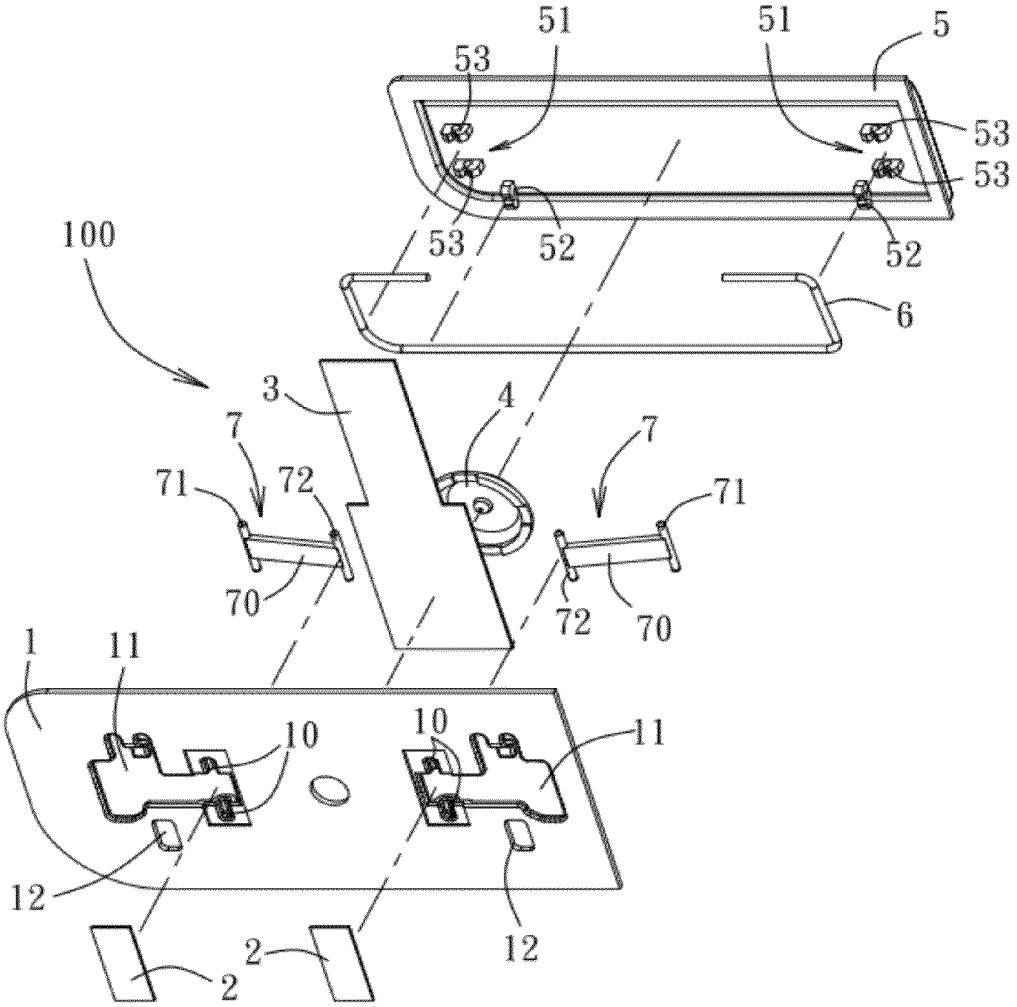
FIG. 2 is an exploded perspective view of a first embodiment of a keyswitch structure according to the invention.

As shown in FIG. 2, the first embodiment of a keyswitch structure 100 according to the present invention can be applied as a part of a keyboard of various electronic devices such as personal digital assistants (PDA), laptops or personal computers(PC). The keyswitch structure 100 includes a bottom board 1, two covering members 2, a circuit board 3, a resilient member 4, a keycap 5, a balancing member 6 and two supporting members 7.

Figure 3:
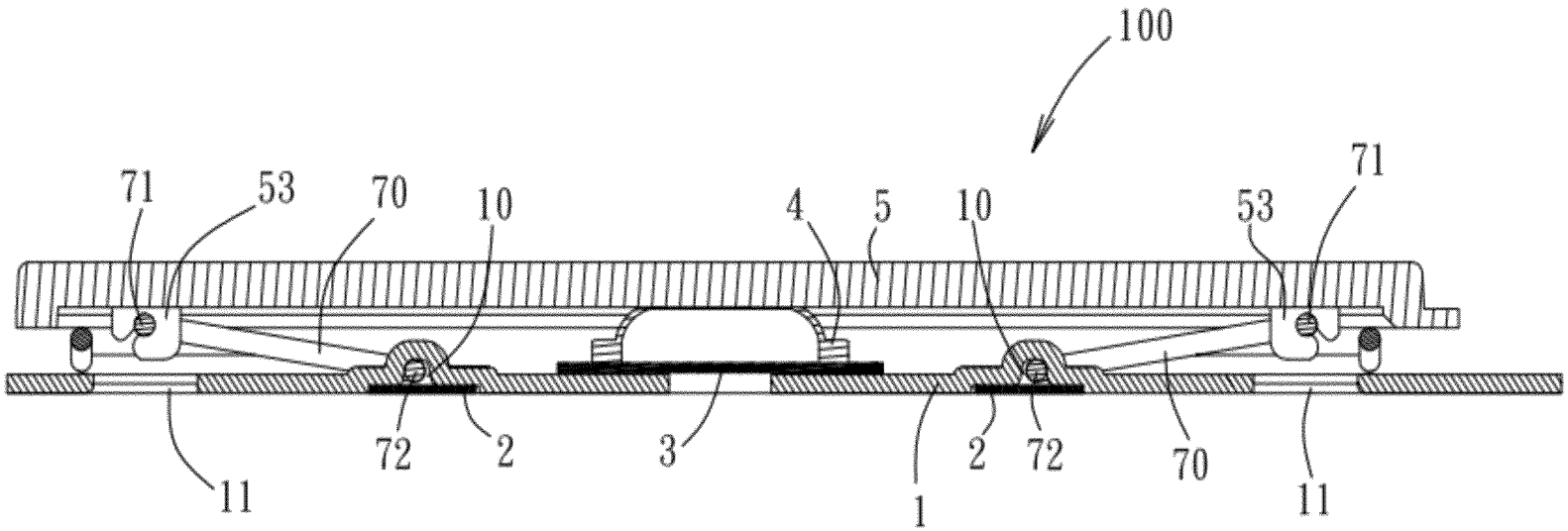
FIG. 3 is a sectional view of the first embodiment, where a key cap of the keyswitch structure is located in an original position.

Further referring to FIG. 3, the bottom board 1 is substantially rectangular, and is formed with two spaced-apart grooves 10 in a bottom surface thereof, two first holes 11 that are spaced apart from each other and that communicate respectively and spatially with the grooves 10, and two second holes 12 that are spaced apart from each other. In this embodiment, each of the grooves 10 has two groove portions extending transversely and oppositely from a corresponding one of the first holes 11. Each of the first holes 11 is larger than each of the supporting members 7. In this embodiment, the covering members 2 are made of Biaxially-oriented polyethylene terephthalate (BoPET), and are configured to cover the grooves 10 in the bottom surface of the bottom board 1, respectively. In other embodiments, the grooves 10 may be formed in a top surface of the bottom board 1, such that the covering members 2 cover the top surface of the bottom board 1.

In this embodiment, the circuit board 3 is a flexible printed circuit (FPC) board disposed on the bottom board 1 and located between the grooves 10. The resilient member 4 is a rubber dome disposed on the circuit board 3 and located between the first holes 11. The resilient member 4 can be pressed to trigger the circuit board 3 so as to generate a corresponding signal which is transmitted to a backend device(not shown in the figures) for processing.

The key cap 5 is located over the bottom board 1, and is for a user to press. The key cap 5 includes two spaced-apart pivoting portions 51 and two spaced-apart engaging seats 52 that are disposed on one side of the key cap 5 adjacent to the bottom board 1. Each of the pivoting portions 51 includes two pivoting seats 53. In this embodiment, a distance between the pivoting portions 51 is longer than that between the grooves 10. The engaging seats 52 are registered respectively with the second holes 12 of the bottom board 1. The balancing member 6 engages the engaging seats 52 of the key cap 5, and is for reducing inclination of the key cap 5 when the key cap 5 is moving vertically with respect to the bottom board 1.

The supporting members 7 are disposed to be registered respectively with the first holes 11. Each of the supporting members 7 includes a supporting plate 70, and a first supporting rod 71 and a second supporting rod 72 connected respectively to opposite ends of the supporting plate 70. The first supporting rods 71 of the supporting members 7 are pivoted respectively to the pivoting portions 51 of the key cap 5. Specifically, the first supporting rod 71 of each of the supporting members 70 is pivoted to the pivoting seats 53 of a respective one of the pivoting portions 51 of the key cap 5. Each of the second supporting rods 72 engages pivotally a closer one of the grooves 10 in the bottom board 1, and is retained in the groove 10 by a corresponding covering member 2. Thus, the first supporting rods 71 of the supporting members 7 are configured to drive the key cap 5 to move vertically with respect to the bottom board 1.

Figure 4:
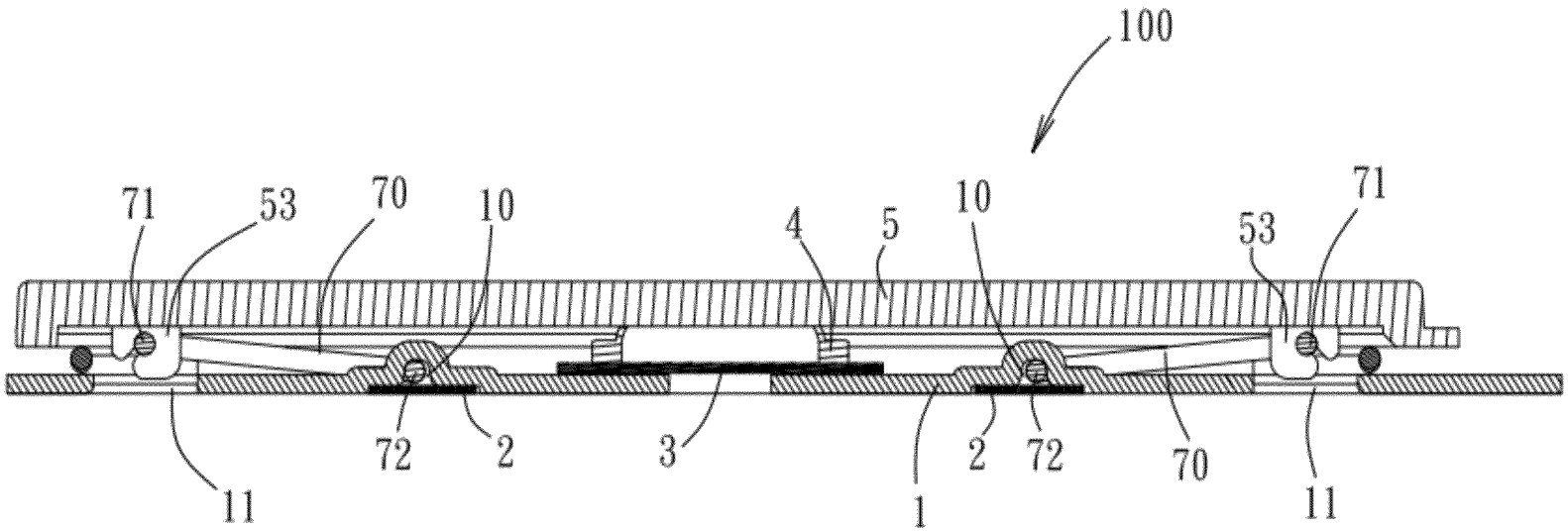
FIG. 4 is another sectional view of the first embodiment, where the key cap of the keyswitch structure is pressed.
Figure 5:
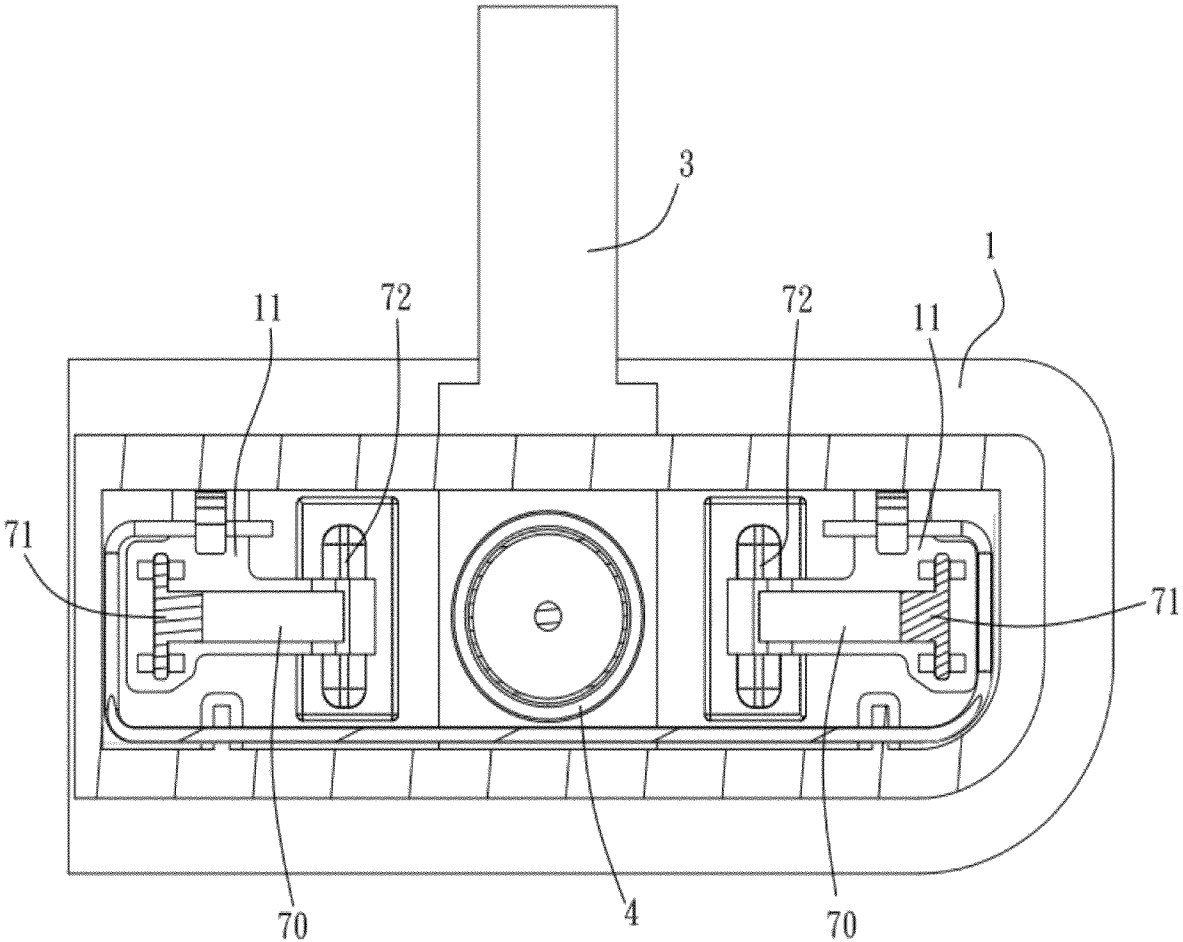
FIG. 5 is a still another sectional view of the first embodiment, where the key cap of the keyswitch structure is pressed.
Figure 6:
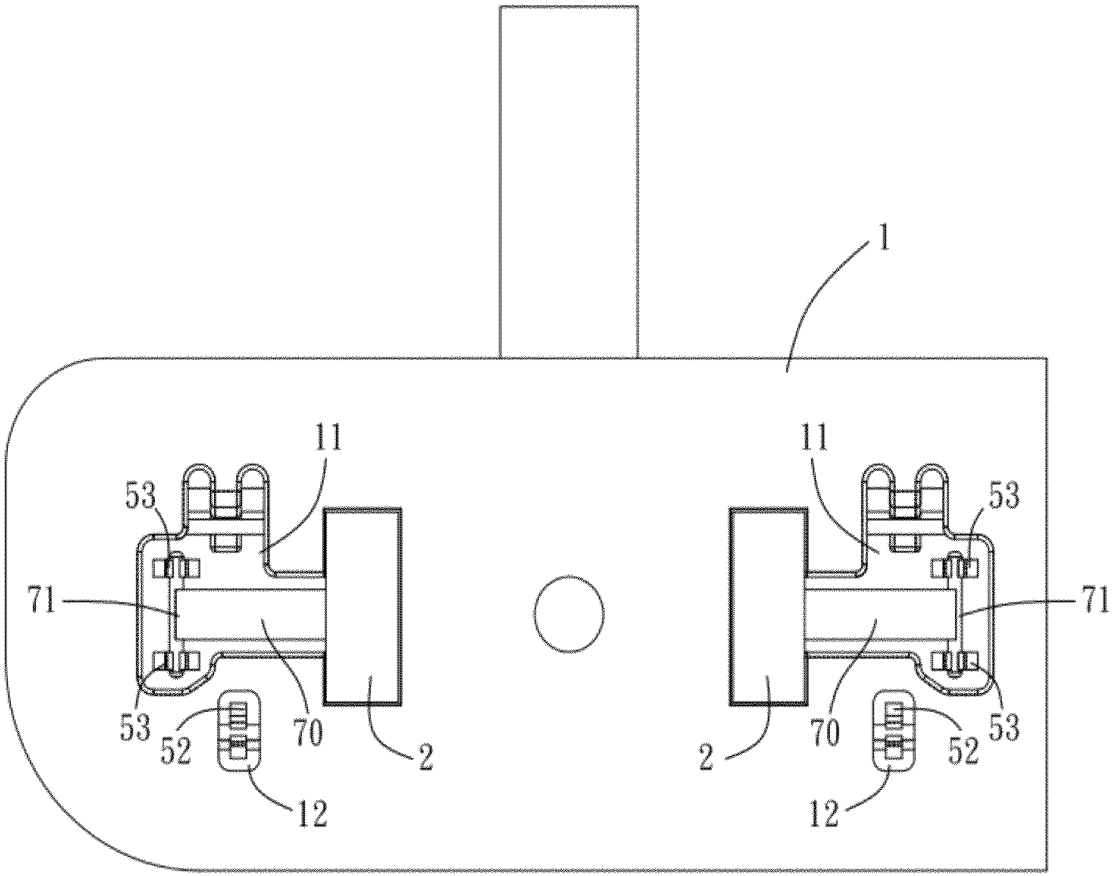
FIG. 6 is a bottom view of the first embodiment.

Further referring to FIGS. 4 and 5, when the key cap 5 is pressed by the user to move toward the bottom board 1 and press the resilient member 4, each of the supporting members 7 engages at least partly a corresponding one of the first holes 11 since each first hole 11 is larger than a respective one of the supporting members 7. Moreover, each of the engaging seats 52 engages a respective one of the second holes 12 (see FIG. 6), thereby further shortening the distance between the key cap 5 and the bottom board 1 while the key cap 5 is pressed, and making the keyswitch structure 100 suitable for use in thin-type keyboards.

When the pressed key cap 5 is released by the user, the resilient member 4 provides a restoring force for restoring the key cap 5 back to its original position, thereby driving the supporting members 7 to move away from the bottom board 1. The keyswitch structure 100 is thus restored to the original state for subsequent use.

Figure 7:
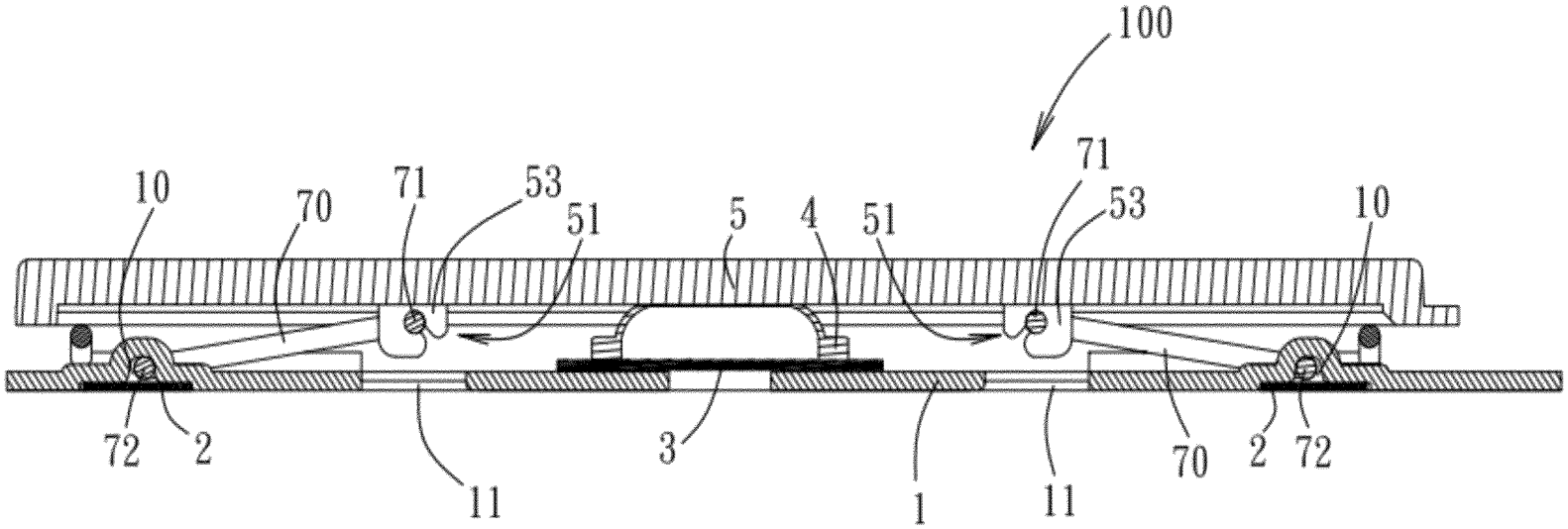
FIG. 7 is a sectional view of a second embodiment of the keyswitch structure according to the invention.

As shown in FIG. 7, the second embodiment of the keyswitch structure 100 according to the present invention has a structure similar to that of the first embodiment. The main difference between this embodiment and the previous embodiment resides in that the distance between the grooves 10 is longer than that between the pivoting portions 51. In this embodiment, when the key cap 5 is pressed by the user and moves toward the bottom board 1, likewise, each of the supporting members 7 engages at least partly a corresponding one of the first holes 11, and each of the engaging seats 52 engages a respective one of the second holes 12, thereby lowering the overall height of the keyswitch structure 100. The second embodiment has the same advantages as those of the first embodiment.

Figure 8:
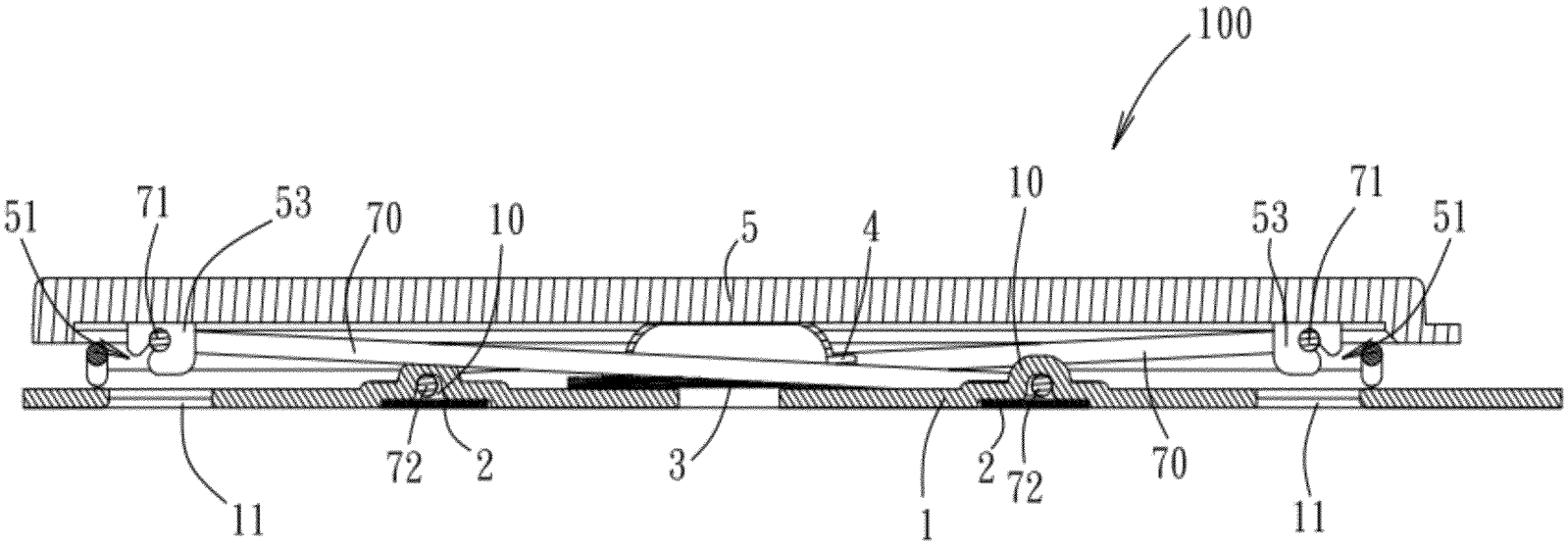
FIG. 8 is a sectional view of a third embodiment of the keyswitch structure according to the invention.

As shown in FIG. 8, the third embodiment of the keyswitch structure 100 according to the present invention has a structure similar to that of the first embodiment. The main difference between this embodiment and the first embodiment resides in the following. While the first supporting rods 71 of the supporting members 7 engage pivotally the pivoting portions 51 of the key cap 5, each of the second supporting rods 72 of the supporting members 7 engages pivotally a farther one of the grooves 10, such that the two supporting members 7 are configured to intersect each other between the key cap 5 and the bottom board 1.

In this embodiment, the distance between the pivoting portions 51 is longer than that between the grooves 10, but may be shorter in other embodiments of this invention. When the key cap 5 is pressed by the user and is moved toward the bottom board 1, each of the supporting members 7 engages at least partly a corresponding one of the first holes 11, and each of the engaging seats 52 engages a respective one of the second holes 12, both serving to lower the height of the keyswitch structure 100. The third embodiment has the same advantages as those of the first embodiment.

To sum up, since the bottom board 1 of the keyswitch structure 100 of this invention is formed with the first holes 11 and the second holes 12, when the key cap 5 is pressed by the user and moves toward the bottom board 1, the supporting members 7 engage at least partly a corresponding one of the first holes 11, and each of the engaging seats 52 engages a respective one of the second holes 12. Such configuration shortens the distance between the key cap 5 and the bottom board 1, thereby lowering the overall height of the keyswitch structure 100.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A keyswitch structure comprising:

a bottom board formed with two first holes that are spaced apart from each other;

a circuit board disposed on said bottom board;

a resilient member disposed on said circuit board and located between said first holes;

a key cap located over said bottom board, and including two pivoting portions that are spaced apart from each other and that are disposed on one side of said key cap adjacent to said bottom board;

two engaging seats which are disposed on said one side of said key cap adjacent to said bottom board and which are spaced apart from each other, wherein said bottom board is further equipped with two second holes which are spaced apart from each other and which are registered, respectively, with said engaging seats; and two supporting members each having an end that is pivoted to a respective one of said pivoting portions of said key cap, and an opposite end that is pivoted to said bottom board, said supporting members being registered respectively with said first holes;

wherein, when said key cap is moved toward said bottom board and presses said resilient member, each of said supporting members engages at least partly a corresponding one of said first holes, each of said engaging seats engages a respective one of said second holes, and said resilient member triggers said circuit board so as to generate a corresponding signal.

2. The keyswitch structure as claimed in claim 1, wherein each of said supporting members includes a supporting plate, and a first supporting rod and a second supporting rod connected respectively to opposite ends of said supporting plate, said first supporting rods of said supporting members being pivoted respectively to said pivoting portions of said key cap, said second supporting rods being pivoted to said bottom board.

3. The keyswitch structure as claimed in claim 2, wherein said bottom board is formed with two spaced-apart grooves in a bottom surface thereof, each of said second supporting rods engaging pivotally a closer one of said grooves.

4. The keyswitch structure as claimed in claim 3, further comprising two covering members covering said grooves, respectively.

5. The keyswitch structure as claimed in claim 2, wherein said bottom board is formed with two spaced-apart grooves in a bottom surface thereof, each of said second supporting rods engaging pivotally a farther one of said grooves, said keyswitch structure further comprising two covering members that cover respectively said grooves.

6. The keyswitch structure as claimed in claim 3, wherein a distance between said pivoting portions is longer than that between said grooves, each of said pivoting portions including two pivoting seats for engaging a corresponding one of said first supporting rods.

7. The keyswitch structure as claimed in claim 5, wherein a distance between said pivoting portions is longer than that between said grooves, each of said pivoting portions including two pivoting seats for engaging a corresponding one of said first supporting rods.

8. The keyswitch structure as claimed in claim 3, wherein a distance between said grooves is longer than that between said pivoting portions, each of said pivoting portions including two pivoting seats for engaging a corresponding one of said first supporting rods.

9. The keyswitch structure as claimed in claim 5, wherein a distance between said grooves is longer than that between said pivoting portions, each of said pivoting portions including two pivoting seats for engaging a corresponding one of said first supporting rods.

10. The keyswitch structure as claimed in claim 1, further comprising a balancing member that engages said engaging seats of said key cap.

11. A keyswitch structure comprising:

a bottom board formed with two first holes that are spaced apart from each other;

a circuit board disposed on said bottom board;

a resilient member disposed on said circuit board and located between said first holes;

a key cap located over said bottom board, and including two pivoting portions that are spaced apart from each other and that are disposed on one side of said key cap adjacent to said bottom board; and two supporting members each having an end that is pivoted to a respective one of said pivoting portions of said key cap, and an opposite end that is pivoted to said bottom board, said supporting members being registered respectively with said first holes;

wherein, when said key cap is moved toward said bottom board and presses said resilient member, each of said supporting members engages at least partly a corresponding one of said first holes, and said resilient member triggers said circuit board so as to generate a corresponding signal;

wherein each of said supporting members includes a supporting plate, and a first supporting rod and a second supporting rod connected respectively to opposite ends of said supporting plate, said first supporting rods of said supporting members being pivoted respectively to said pivoting portions of said key cap, said second supporting rods being pivoted to said bottom board; and wherein said bottom board is formed with two spaced-apart grooves in a bottom surface thereof, each of said second supporting rods engaging pivotally one of said grooves, and each of said grooves is covered completely for retaining a corresponding one of said second supporting rods therein.

12. The keyswitch structure as claimed in claim 11, further comprising two covering members each covering a respective one of said grooves.

13. The keyswitch structure as claimed in claim 12, wherein each of said second supporting rods engages pivotally a closer one of said grooves.

14. The keyswitch structure as claimed in claim 12, wherein each of said second supporting rods engages pivotally a farther one of said grooves.

15. The keyswitch structure as claimed in claim 13, wherein a distance between said pivoting portions is longer than that between said grooves, each of said pivoting portions including two pivoting seats for engaging a corresponding one of said first supporting rods.

16. The keyswitch structure as claimed in claim 14, wherein a distance between said pivoting portions is longer than that between said grooves, each of said pivoting portions including two pivoting seats for engaging a corresponding one of said first supporting rods.

17. The keyswitch structure as claimed in claim 13, wherein a distance between said grooves is longer than that between said pivoting portions, each of said pivoting portions including two pivoting seats for engaging a corresponding one of said first supporting rods.

18. The keyswitch structure as claimed in claim 14, wherein a distance between said grooves is longer than that between said pivoting portions, each of said pivoting portions including two pivoting seats for engaging a corresponding one of said first supporting rods.

19. The keyswitch structure as claimed in claim 12, wherein:

said key cap further includes two engaging seats that are disposed on said one side of said key cap adjacent to said bottom board and that are spaced apart from each other;

said bottom board is further formed with two second holes that are spaced apart from each other and that are registered respectively with said engaging seats; and when said key cap is moved toward said bottom board and presses said resilient member, each of said engaging seats engages a respective one of said second holes.

20. The keyswitch structure as claimed in claim 19, further comprising a balancing member that engages said engaging seats of said key cap.

* * * * *